US011346170B2

(12) United States Patent
Alsahlawi et al.

(10) Patent No.: US 11,346,170 B2
(45) Date of Patent: May 31, 2022

(54) METHOD AND APPARATUS OF INTELLIGENT DOWNHOLE MULTI-FUNCTION INFLATABLE SYSTEM FOR OIL AND GAS WELLS

(71) Applicant: SAUDI ARABIAN OIL COMPANY, Dhahran (SA)

(72) Inventors: Ziyad M. Alsahlawi, Dhahran (SA); Mahmoud Adnan Alqurashi, Dhahran (SA); Ossama R. Sehsah, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/030,756

(22) Filed: Sep. 24, 2020

(65) Prior Publication Data

US 2022/0090456 A1 Mar. 24, 2022

(51) Int. Cl.

| | |
|---|---|
| ***E21B 23/04*** | (2006.01) |
| ***E21B 34/08*** | (2006.01) |
| ***E21B 23/00*** | (2006.01) |

(52) U.S. Cl.

CPC ..... *E21B 23/0412* (2020.05); *E21B 23/001* (2020.05); *E21B 23/0413* (2020.05); *E21B 34/08* (2013.01)

(58) Field of Classification Search

CPC .... E21B 23/001; E21B 23/04; E21B 23/0412; B63B 22/10; B63B 22/12

See application file for complete search history.

(56) References Cited

U.S. PATENT DOCUMENTS

| | | | | |
|---|---|---|---|---|
| 3,123,842 | A * | 3/1964 | Oeland | B63B 22/12 441/9 |
| 3,937,278 | A | 2/1976 | Sheshtawy | |
| 5,676,209 | A | 10/1997 | Reynolds | |
| 6,155,748 | A | 12/2000 | Allen et al. | |
| 7,363,967 | B2 | 4/2008 | Burris, II et al. | |
| 7,884,951 | B2 | 2/2011 | Prouvost et al. | |
| 8,967,241 | B2 | 3/2015 | Xu et al. | |

(Continued)

FOREIGN PATENT DOCUMENTS

| | | |
|---|---|---|
| DE | 2358371 A1 | 5/1975 |
| JP | 4902808 B2 | 3/2012 |

(Continued)

OTHER PUBLICATIONS

International Search Report and Written Opinion issued in Application No. PCT/US2021/051978, dated Jan. 19, 2021 (11 pages).

*Primary Examiner* — Giovanna Wright

(74) *Attorney, Agent, or Firm* — Osha Bergman Watanabe & Burton LLP

(57) ABSTRACT

An inflatable multifunctional downhole tool includes a body having an outer shell and a threaded connection at an axial end of the body, at least one pressurized container disposed inside the outer shell, the pressurized container containing compressed gas, a plurality of floatation chambers fluidly connected through connection lines to the at least one pressurized container, a dissolvable plug positioned along each of the connection lines between the floatation chambers and the at least one pressurized container, and a tool sub threadably connected to the threaded connection of the body.

20 Claims, 11 Drawing Sheets

(56) References Cited

U.S. PATENT DOCUMENTS

| | | | | |
|---|---|---|---|---|
| 10,352,128 | B1 * | 7/2019 | Saraya | E21B 34/10 |
| 2003/0045189 | A1 * | 3/2003 | Cole, Jr. | B63B 22/12 441/133 |
| 2011/0252879 | A1 | 10/2011 | Madhavan et al. | |
| 2013/0211723 | A1 | 8/2013 | Weston et al. | |
| 2014/0131045 | A1 | 5/2014 | Loiseau et al. | |

FOREIGN PATENT DOCUMENTS

| | | | |
|---|---|---|---|
| WO | 2015196059 | A1 | 12/2015 |
| WO | 2016195674 | A1 | 12/2016 |
| WO | 2017105415 | A1 | 6/2017 |

* cited by examiner

METHOD AND APPARATUS OF INTELLIGENT DOWNHOLE MULTI-FUNCTION INFLATABLE SYSTEM FOR OIL AND GAS WELLS

BACKGROUND

In the oil and gas industry, a well may be drilled into a formation for exploration and recovery of natural resources. Three major phases of drilling a well are penetrating the formation, evaluating the penetrated formation (e.g., logging, coring and flow back), and casing the open hole by running in and cement casing. FIG. 1 shows an example of a well 10 extending into a formation 11. The well 10 may extend through many formation layers, including, for example, unconsolidated rock, cap rock, a water reservoir, and/or hydrogen bearing formation layers. The drilled hole, where the formation 11 forms an exposed wall of the hole, may be referred to as a borehole or wellbore 12. As the well 10 is drilled, one or more types of casing, e.g., surface casing 13, intermediate casing 14, production casing, and/or liner(s), may be directly or indirectly hung from a well head 15 at the surface of the well 10, where the casing may be cemented to and line the wellbore wall. A drill string 16 (connected-together drill pipe), coiled tubing, wireline, and/or slick line may be used to lower a connected drill bit 17 or other well tool to a desired depth within the well 10.

During the life of the well, different operations may be performed, such as measuring the downhole temperature, determining well deviation, fishing operations, collecting downhole samples, drilling the formation, cementing a casing, etc. Such operations require rigging up the related equipment, running the necessary tools in hole, performing the job, and pulling the tools out of hole. Increased risks/safety concerns, costs, and technical complications arise from each change in job sequence of operations. For example, running a drill string in hole may cause a surge of drilling fluid, which may lead to downhole loss of circulation or swap, where the well may become underbalanced and formation fluid enters the wellbore. Additionally, drilling rig crew are used to make up or lay down drill pipe joints while the drill string is run in or pulled out of hole. Working around tubulars has a number of potential hazards, and is where most injuries occur in drilling operations.

Further, running in and pulling out tools from a well also increases non-productive time. For example, the average time required to run in hole 1000 feet of drill pipe is estimated to be one hour. Thus, running a drill string in hole to a total depth of 10,000 feet to perform a simple operation in a well may require about 24 hours (e.g., including preparing the rig floor and equipment, running the drill string in hole, and pulling the drill string out of hole). Such time to perform the job results in expensive costs to the operating company.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments of the present disclosure relate to downhole tools that include a body having an outer shell and a threaded connection at an axial end of the body, at least one pressurized container disposed inside the outer shell, the pressurized container containing compressed gas, a plurality of floatation chambers fluidly connected through connection lines to the at least one pressurized container, a dissolvable plug positioned along each of the connection lines between the floatation chambers and the at least one pressurized container, and a tool sub threadably connected to the threaded connection of the body.

In another aspect, embodiments of the present disclosure relate to methods that include providing an inflatable downhole tool having at least one pressurized container disposed inside an outer shell of the inflatable downhole tool, a plurality of floatation chambers fluidly connected through connection lines to the at least one pressurized container, and a dissolvable plug positioned along each of the connection lines between the floatation chambers and the at least one pressurized container. A tool sub may be connected to an axial end of the inflatable downhole tool. The inflatable downhole tool may be sent down a well, at least one activation mechanism may be triggered to dissolve at least one of the dissolvable plugs, and when the at least one dissolvable plug dissolves, at least one of the floatation chambers may be inflated with compressed gas from the pressurized container(s) to float the inflatable downhole tool to an uphole position in the well.

In yet another aspect, embodiments of the present disclosure relate to methods of assembling a downhole tool that may include providing a body of an inflatable downhole tool having an outer shell and a threaded connection at an axial end of the body, providing a plurality of floatation chambers inside the outer shell, providing at least one pressurized container inside the body, wherein connection lines fluidly connect the at least one pressurized container to the floatation chambers, positioning a dissolvable plug in at least one connection line to plug an opening to the pressurized container, and attaching a tool sub to the threaded connection.

Other aspects and advantages will be apparent from the following description and the appended claims.

DETAILED DESCRIPTION

Figure 1:
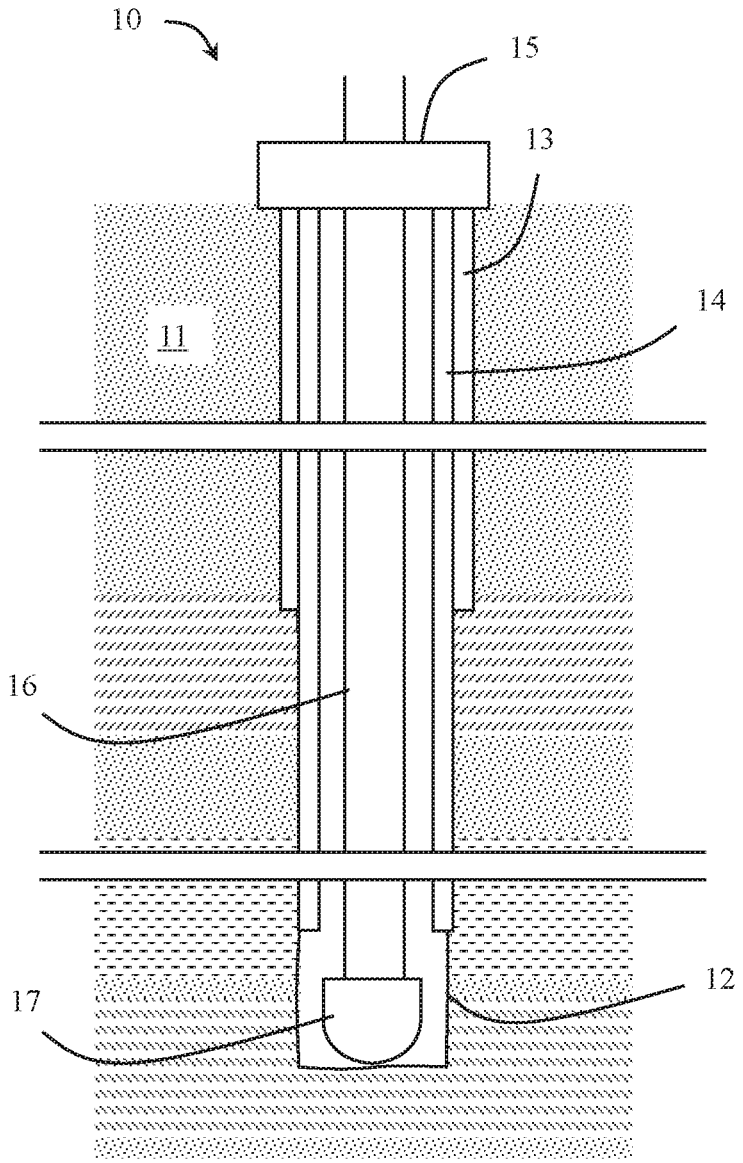
FIG. 1 shows a diagram of a typical well system.

In one aspect, embodiments disclosed herein relate to inflatable multifunctional downhole tools and their deployment and retrieval. For example, inflatable downhole tools may be dropped into a well, where gravity may pull the inflatable downhole tool a vertical distance through the well.

In some embodiments, a wheel system may aid the inflatable downhole tool to reach a target downhole location (e.g., in a horizontal or deviated section of the well), and once a job is performed, to return from the target downhole location to a vertical section of the well. Further, after a downhole job is completed, inflatable components within the inflatable downhole tool may be inflated to send the inflated downhole tool up a vertical section of the well to be retrieved near the top of the well. Inflatable downhole tools disclosed herein may have different tool subs interchangeably connected to the inflatable downhole tool body to perform different downhole jobs.

As used herein, the term "coupled" or "coupled to" or "connected" or "connected to" may indicate establishing either a direct or indirect connection, and is not limited to either unless expressly referenced as such. Wherever possible, like or identical reference numerals are used in the figures to identify common or the same elements. The figures are not necessarily to scale and certain features and certain views of the figures may be shown exaggerated in scale for purposes of clarification.

Figure 2:
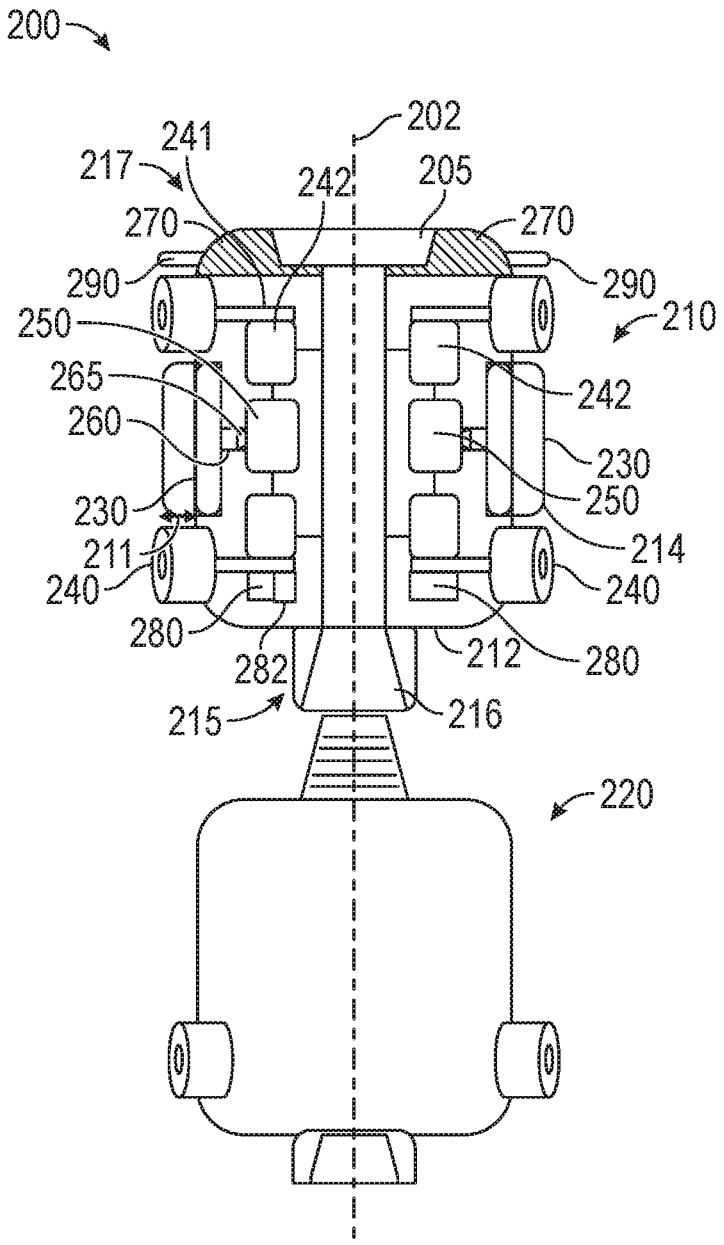
FIG. 2 shows a cross-sectional view of an inflatable multifunctional downhole tool with deflated floatation chambers according to embodiments of the present disclosure.
Figure 3:
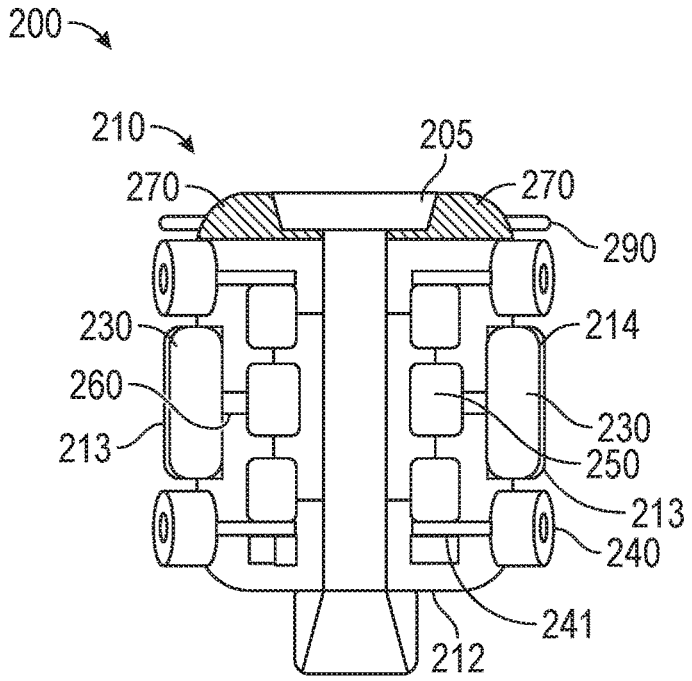
FIG. 3 shows a cross-sectional view of the inflatable multifunctional downhole tool in FIG. 2 with the floatation chambers inflated.
Figure 4:
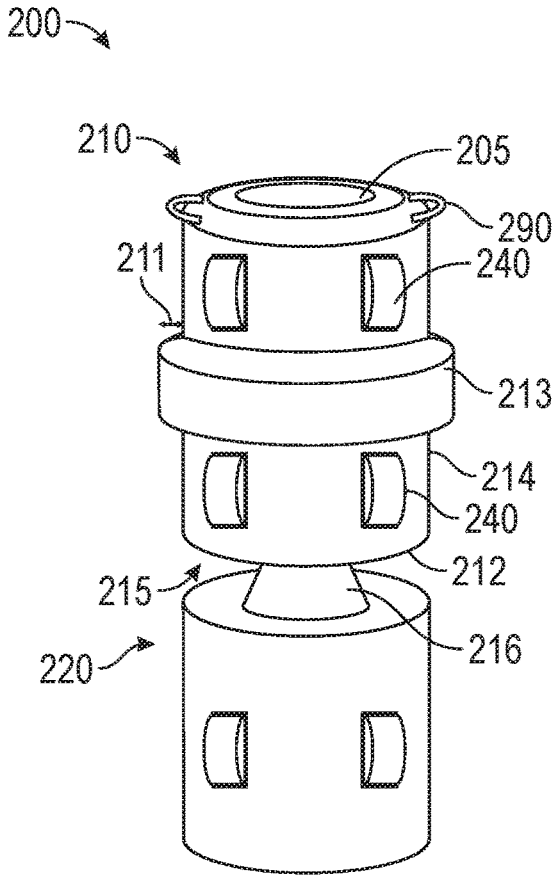
FIG. 4 shows a side view of the inflatable multifunctional downhole tool of FIGS. 2 and 3.

FIGS. 2-4 show an example of an inflatable multifunctional downhole tool 200 according to embodiments of the present disclosure, where FIGS. 2 and 3 show a cross sectional view along a longitudinal axis of the tool 200, and FIG. 4 shows a perspective side view of the tool 200. The inflatable multifunctional downhole tool 200 includes an inflatable downhole tool 210 forming the inflatable portion of the inflatable multifunctional downhole tool 200, where a tool sub 220 may be attached to the inflatable downhole tool 210 to perform a downhole job. Different tool subs 220 may be attached to perform different downhole jobs. For example, a tool sub 220 may include a logging tool to take one or more types of measurements downhole. In some embodiments, a tool sub 220 may include a fishing tool, which may be used to retrieve an item from a downhole location.

The inflatable downhole tool 210 may include a body 212 having an outer shell 214. A threaded connection 216 may be provided at a first axial end 215 of the body 212, and a second connection end may be provided at a second axial end 217 opposite the first axial end 215. The threaded connection 216 may include, for example, standard-type threads, as designated by the American Petroleum Institute (API) to enable compatibility between multiple types of tool subs 220. Further, the threaded connection shown in FIG. 2 shows a box threaded connection 216 on the inflatable downhole tool 210 and a pin threaded connection on the tool sub 220. However, other embodiments may be configured to provide a pin threaded connection 216 on the inflatable downhole tool 210 such that tool subs 220 having a box threaded connection may be threadably attached to the inflatable downhole tool 210.

The second connection end at the second axial end 217 of the body 212 may include, for example, a threaded connection, shear pins, j-slots, or other releasable connection types. For example, in some embodiments, the second connection end of the body 212 may have a running tool or other launch type tool releasably connected to the second connection end of the body 212 using locking pins, where the running tool may be used to lower the multifunctional downhole tool 200 below a wellhead. Once lowered below the wellhead, the running tool may be rotated to collapse the locking pins, thereby releasing the multifunctional downhole tool 200 to drop into the well.

When the multifunctional downhole tool 200 is dropped into a well, gravity may be a main driving force in moving the tool 200 through the well. In some embodiments, the multifunctional downhole tool 200 may be moved to a target depth in the well using only gravity. In some embodiments, the multifunctional downhole tool 200 may be moved to a target depth in the well using a combination of gravity and motorized wheels 240. For example, as shown in FIGS. 2-4, a plurality of wheels 240 (or spherical shaped rollers) may be positioned around the outer shell 214 of the body 212, which may aid in moving the tool 200 through a section of a well. At least one motor 241 and power source 242 may be provided inside the body 212 and operatively connected to the wheels 240 to turn the wheels 240. The wheels 240 may be rotated along an axis tangent to the body 212 in an azimuth direction around the circumference of the body 212. In such manner, the wheels 240 may propel the inflatable multifunctional downhole tool 200 in an axial direction parallel with the tool's longitudinal axis 202.

A wireless communication system may be provided inside the inflatable downhole tool body 212, which may be in wireless communication with one or more computing devices provided at the surface of the well and/or with one or more devices in the inflatable multifunctional downhole tool 200. For example, a wireless communication system may include at least one of programmable logic controller(s) (PLC) 280 and a navigation system 282. One or more PLCs 280 may be held inside the body 212 and operatively connected to the wheel motors 241 and/or the navigation system 282. The PLCs may process inputs received from other components of the wireless communication system and/or computing system(s) located outside of the well, execute instructions, and send outputs based on the provided information and written logic. In some embodiments, the PLCs 280 may continuously monitor the state of input devices (e.g., a navigation system 282, rotation of the wheels 240, a device from outside of the well sending signals to the PLCs, etc.) and make decisions based upon a custom program to control the state of output devices (e.g., the motor 241 to the wheels 240).

For example, in some embodiments, the navigation system 282 may detect the location of the downhole tool body 212 within a well. The PLCs may continuously monitor the tool's location in the well by receiving inputs from the navigation system 282, and make decisions based upon a software program stored in the PLCs to control the state of one or more output devices, such as the wheel motors 241, pressurized containers 250 (described more below), and/or a communication system in the tool sub 220. For example, when the navigation system 282 detects the location of the inflatable multifunctional downhole tool 200 to be at a target depth in the well, based on the detected location, the PLC(s) may send instructions to a communication system in the tool sub 220 to perform a designated job of the tool sub 220.

The outer shell 214 of the inflatable downhole tool 210 may be made of a material capable of withstanding downhole pressure and temperature, including but not limited to steel or aluminum. The outer shell 214 may provide protection for components inside the inflatable downhole tool body 212, for example, when traveling through deviated sections of a well, or past protruding components in the well. As best shown in FIG. 4, the body 212 may have a generally cylindrical shape, where the outer shell 214 forms one or more protrusions 213 extending outwardly along the side of the body 212. For example, a protrusion 213 may have a toroidal shape extending around the entire circumference of the body (e.g., as shown in FIG. 4), or a plurality of spaced apart protrusions may extend around the side of the body 212. The protrusion(s) 213 may have an extension profile extending a radial distance 211 that is less than the protruding distance of the wheels 240, such that the wheels 240 may contact an inner wall of a well before the protrusion 213 does. The interior cavity formed within protruding areas of the outer shell 214 may provide area inside the body 212 for one or more expandable floatation chambers 230 to be inflated and expand into the interior cavity.

The inflatable downhole tool 210 and tool sub 220 may both be designed to have an outermost diameter that is less than an inner diameter of a well, which may enable the tool 200 to be used in the well effectively. For example, when using the tool 200 in a well having a 5-⅞-inch inner diameter, tool 200 (including the inflatable downhole tool 210 and the tool sub 220) may be designed to have an outermost diameter that is less than 5-⅞-inch (the well inner diameter), e.g., a 4-½-inch outermost diameter. Further, the tool 200 may be designed to have an outermost diameter that is the minimum size possible to perform the job of the tool sub 220 to ensure smooth travel through the well to the target depth and also provide enough internal floating components to ensure the tool 200 can float back to the surface of the well.

One or more expandable floatation chambers 230 may be positioned inside the body 212. In embodiments where the outer shell 214 forms a protrusion(s) 213, the expandable floatation chambers 230 may be held proximate to the interior cavity formed by the protrusion(s) 213, such that when the floatation chamber(s) 230 is inflated, the floatation chamber(s) 230 may expand into and at least partially fill the interior cavity. For example, floatation chambers 230 are shown in a deflated configuration in FIG. 2 and in an inflated configuration in FIG. 3. When the floatation chambers 230 are inflated, the floatation chambers 230 may fill (either partially or entirely) the protrusion 213 formed by the outer shell 214. In embodiments without protrusion(s) 213, the floatation chambers 230 may expand into hollow portions of the body 212.

Floatation chambers 230 may be formed of a flexible material, such as a reinforced polymer material, one or more polymers (e.g., polymers selected from polyethylene (PE), polypropylene (PP), polyether ether ketone (PEEK), polyethyleneimine (PEI), polyoxymethylene (POM), polyketone (PK), nylon (polyamide polymers), and polyethylene terephthalate (PET)), thin flexible metals, or other downhole bladder materials. Further, the floatation chambers 230 may be formed of a flexible material that is suitable for high pressure, high temperature environments to inhibit degradation when in a well.

At least one pressurized container 250 disposed inside the body 212 and fluidly connected to the floatation chambers 230 may be used to inflate the floatation chambers 230. The pressurized container(s) 250 may be filled with a compressed gas, such as carbon dioxide ($CO_2$), which may be held in the pressurized container(s) using one or more valves. A pressurized container 250 may be fluidly connected to one or more of expandable floatation chambers 230 through connection lines 260. When the connection lines 260 are open and fluidly connect an opening to the pressurized container 250 and an opening to the floatation chamber 230, compressed gas held within the pressurized container 250 may be released and expanded into the floatation chamber 230.

According to embodiments of the present disclosure, a dissolvable plug 265 may be positioned along each of the connection lines 260 between the expandable floatation chambers 230 and the pressurized container(s). The dissolvable plug 265 may have a size and shape that entirely plugs a section of the connection line 260. For example, when plugging a tubular connection line 260, the dissolvable plug 265 may have an outer diameter that is substantially equal to the inner diameter of the connection line 260, such that the dissolvable plug 265 may provide a fluid-tight seal in the connection line 260.

Dissolvable plugs 265 may be made of a material that dissolves upon an activation trigger. For example, the dissolvable plug 265 may be made of a material that may start to dissolve after the tool 200 is submerged in well fluids for certain time, or may be made of material that dissolves upon exposure to an acid (which may be provided by a dissolvable plug system in the tool body 212). Once the dissolvable plug dissolves, gas from the pressurized container may be released from the pressurized container 250 to flow through the connection line(s) 260 and inflate the fluidly connected floatation chambers 230. Suitable material for use as a dissolvable plug 265 may include, for example, magnesium alloys, epoxy resins or other polymer materials.

When the floatation chambers 230 are inflated with gas from the pressurized containers 250, the inflated floatation chambers 230 may provide buoyancy to the multifunctional downhole tool 200. Once the multifunctional downhole tool 200 is substantially buoyant, the tool's buoyancy may float the inflatable multifunctional downhole tool 200 to an upper portion of the well (e.g., proximate the surface of the well), where it may be retrieved. The multifunctional downhole tool 200 may be considered substantially buoyant when it displaces at least half of its weight when provided in well fluid (e.g., drilling fluid or production fluid), or when its overall density is less than the density of the well fluid.

In one or more embodiments, an inflatable multifunctional downhole tool 200 may also have at least one buoyancy element 270 in addition to the floatation chambers 230. Buoyancy element(s) 270 may be provided inside the tool body 212, for example, by lining the interior of the outer shell 214 with one or more buoyancy elements 270 or otherwise holding the buoyancy element(s) 270 inside the tool body 212. Buoyancy element(s) 270 may be made of a foam, for example, that is resistant to hydrostatic pressure, oil, grease, and solvent, such as polyurethane foam. Buoyancy element(s) 270 may help lower the overall density of the inflatable multifunctional downhole tool 200, which may aid in its floatation once the floatation chambers 230 are filled with gas.

When the floatation chambers 230 are inflated, the downhole tool 210 may float in the well fluids toward the surface of the well. The tool sub 220 may remain connected to the downhole tool 210 when the floatation chambers 230 are inflated, or the tool sub 220 may be disconnected (and left in the well) prior to inflating the floatation chambers 230 to float the downhole tool 210. When the inflated downhole tool 210 is floated to proximate the surface of the well (e.g., below a wellhead), a retrieving tool may be used to retrieve the inflated downhole tool 210 and pull the inflated downhole tool 210 out of the well. One or more hooks 290 or other connection types may be provided on the tool body 212 (e.g., on or near the second axial end 217 of the body 212), which may be used to allow a retrieving tool to connect to the downhole tool 210 and pull the downhole tool 210 out of the well.

Figure 5:
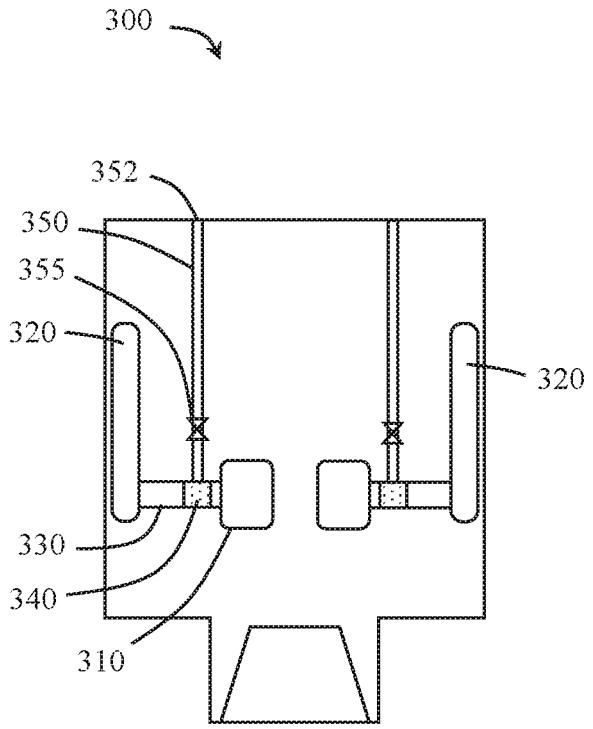
FIG. 5 shows a cross-sectional view of an inflatable downhole tool according to embodiments of the present disclosure.
Figure 6:
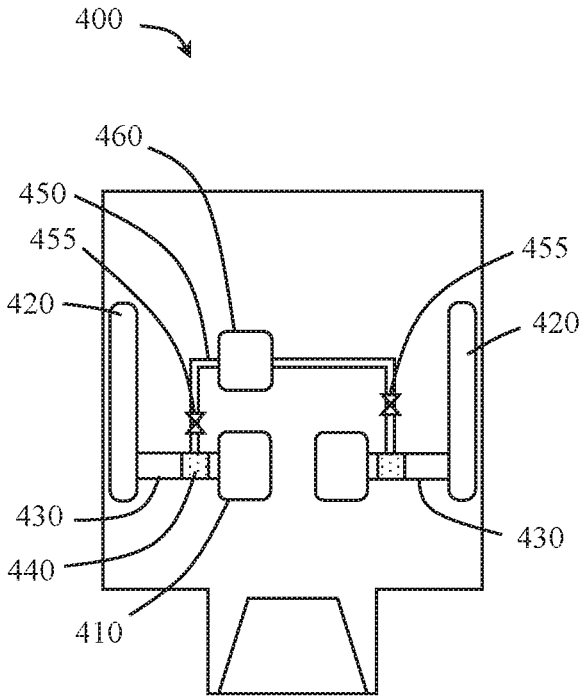
FIG. 6 shows a cross-sectional view of another inflatable downhole tool according to embodiments of the present disclosure.

FIGS. 5 and 6 show additional examples of inflatable downhole tools according to embodiments of the present disclosure having different dissolvable plug systems. FIG. 5 shows a cross sectional view of an inflatable downhole tool 300 that has at least one pressurized container 310 fluidly connected to at least one floatation chamber 320 via fluid connection lines 330. A dissolvable plug 340 may be disposed inside and plug each of the fluid connection lines 330. One or more fluid access lines 350 may fluidly connect the dissolvable plug 340 to the exterior of the inflatable downhole tool 300, where a fluid access line 350 may have a first opening intersecting with a fluid connection line 330 at a location proximate to the dissolvable plug 340 and a second opening 352 in fluid communication with the exterior of the inflatable downhole tool 300. In such manner, fluid around the exterior of the inflatable downhole tool 300 (e.g., well fluids surrounding the downhole tool 300 when sent down a well) may seep into the downhole tool 300 and contact the dissolvable plug 340. When exterior fluids saturate and dissolve the dissolvable plug 340, compressed gas from within the pressurized container 310 may flow through the fluid connection line to fill and inflate the floatation chamber 320.

The fluid access line(s) 350 may be designed to have a diameter that allows a selected flow rate of exterior fluids through the fluid access line(s) 350. By designing an allowable flow rate of exterior fluids through the fluid access line(s) 350, the dissolving of the dissolvable plug 340 may be delayed for an approximate selected time (the approximated time for the exterior fluids to flow through the fluid access line 350 and dissolve the dissolvable plug 340), which may allow a connected tool sub to perform a job prior to inflating the floatation chambers 320. In some embodiments, a valve 355 may be positioned along the fluid access line 350. The valve 355 may be a one-way valve or a check valve designed to allow exterior fluid to flow from the exterior of the downhole tool 300 to the dissolvable plug 340 under a designed pressure differential. For example, when the dissolvable plug 340 is plugging the fluid connection line 330 and blocking expansion of the compressed gas inside the pressurized container 310, the pressure differential between the upstream side of the valve 355 (on the side facing the exterior of the tool 300) and the downstream side of the valve 355 (on the side facing the dissolvable plug 340) may allow exterior fluid flow through the valve 355. When the dissolvable plug 340 dissolves and allows flow of the compressed gas from the pressurized container 310, the pressure differential between the upstream side of the valve 354 and the downstream side of the valve 355 may prevent exterior fluid flow through the valve 355.

FIG. 6 shows a cross sectional view of an inflatable downhole tool 400 that has at least one pressurized container 410 fluidly connected to at least one floatation chamber 420 via fluid connection lines 430. A dissolvable plug 440 may be disposed inside and plug each of the fluid connection lines 430. One or more fluid access lines 450 may fluidly connect the dissolvable plug 440 to one or more fluid source compartments 460, where a fluid access line 450 may have a first opening intersecting with a fluid connection line 430 at a location proximate to the dissolvable plug 440 and a second opening in fluid communication with the fluid source compartment(s) 460. In such manner, fluid from a fluid source compartment may seep through the fluid access lines 450 and contact the dissolvable plug 440. When fluid from the fluid source compartment saturates and dissolves the dissolvable plug 440, compressed gas from within the pressurized container 410 may flow through the fluid connection line 430 to fill and inflate the floatation chamber 420.

In the embodiment shown, multiple fluid access lines 450 may fluidly connect a single fluid source compartment 460 to multiple fluid connection lines 430. In other embodiments, more than one fluid source compartment 460 may be provided in a downhole tool 400, where at least one fluid access line 450 may connect each fluid source compartment 460 to dissolvable plugs 440.

In some embodiments, a valve 455 may be positioned along each of the fluid access lines 450, between openings to the fluid source compartment(s) 460 and the fluid connection line(s) 430. When the valve 455 is in the closed configuration, fluid from the fluid source compartment(s) 430 may be prevented from contacting and dissolving the dissolvable plug(s) 440. When the valve 455 is activated to be in an open configuration, fluid from the fluid source compartment(s) 460 may flow through the fluid access lines 450 to contact and dissolve the dissolvable plug 440. The valve 455 may be activated to open, for example, with a timer, wireless activation signal, pressure differential (e.g., from a well pressure at the target depth in the well), or other activation mechanism.

The fluid stored in a fluid source compartment 460 may be selected based on the type of material forming the dissolvable plug 440. For example, fluid stored in a fluid source compartment 460 may include an acid, such as hydrochloric acid.

The timing of when a dissolvable plug dissolves may be controlled to allow compressed gas to be released into floatation chambers in an inflatable downhole tool and float the inflatable downhole tool to the surface of the well after completion of a downhole job is performed by an attached tool sub. For example, the timing of when a dissolvable plug is exposed to a dissolving fluid and dissolves may be controlled using timer activated valves, where one or more timer devices may activate the valve to open and expose a dissolvable plug to a dissolving liquid. In some embodiments, the timing of when a dissolvable plug is exposed to a dissolving fluid and dissolves may be controlled using pressure activated valves, where the valve may be activated to open upon reaching a selected downhole pressure (e.g., the downhole pressure at the target depth in the well). In some embodiments, with or without using a valve to expose a dissolvable plug to dissolving fluid, the timing of when the dissolvable plug dissolves may be controlled by selecting a size and material type of the dissolvable plug to design a dissolving rate of the dissolvable plug that corresponds with timing of sending the downhole tool to a target depth in a well and performing a downhole job. For example, by selecting a relatively larger plug and/or a plug material of a magnesium alloy, the dissolving rate may be decreased, thereby providing a relatively longer time for the dissolvable plug to dissolve when compared to dissolvable plugs having a smaller size and/or a plug material made of an epoxy or other polymer material.

The dissolvable plug system (e.g., including the dissolvable plug size and material, valve type, dissolving fluid type (e.g., type of fluid stored in a fluid source compartment or well fluid), and the amount of dissolvable plugs) may be designed and/or operated in tandem with the design and/or operation of the inflatable multifunctional downhole tool. For example, an inflatable multifunctional downhole tool may be designed to perform downhole job(s) at greater well depths by designing the dissolvable plug system to dissolve the dissolvable plug(s) at a slower dissolving rate and/or by initiating dissolving the dissolvable plug(s) after longer periods of time (e.g., waiting longer from sending the tool downhole until valve(s) are opened to expose the dissolvable plug to dissolving fluid).

According to embodiments of the present disclosure, an inflatable multifunctional downhole tool may be assembled by providing a body of an inflatable downhole tool having an outer shell and a threaded connection at an axial end of the body. A plurality of expandable floatation chambers may be provided inside the outer shell. The amount and/or size of the floatation chambers may be selected based on, for example, the anticipated weight of a tool sub to be attached to the body and/or the size of the body. The floatation chambers may be held (e.g., using one or more brackets, adhesive, or other attachment method) within a selected location inside the body that allows enough room for the floatation chambers to expand when filled with gas. For example, a floatation chamber may be held in a selected location inside the body, where the selected location is a hollow area in the body that has an area at least three times greater than the deflated floatation chamber.

At least one pressurized container may also be provided inside the body and fluidly connected to the floatation chambers using connection lines. The pressurized container(s) may be held in a selected location inside the body, for example, using brackets or tack welds. The pressurized container(s) may be filled with a compressed gas prior to or after installing the pressurized container(s) in the body. The size of the pressurized container(s), the amount of pressurized container(s) provided in the body, and/or the amount of compressed gas filled into the pressurized container(s) may be selected based on, for example, the weight of the tool sub to be attached to the body and/or the size of the body.

A dissolvable plug may be positioned in a connection line to plug the fluid connection between a pressurized container and a floatation chamber. The dissolvable plug may be installed in a connection line prior to or after the connection line is connected to the pressurized container and/or floatation chamber. For example, in some embodiments, a connection line may be installed to fluidly connect a pressurized container to a floatation chamber. After the connection line is installed, a polymer-based dissolvable plug may be injected into a portion of the connection line.

In some embodiments, floatation chambers may be inflated using methods of releasing compressed gas from a pressurized container other than a dissolvable plug system. For example, in some embodiments, release of compressed gas from a pressurized container may be activated based on hydrostatic pressure and/or temperature, where once the pressure and/or temperature is reached, the compressed gas may be released to start the floatation phase. In some embodiments, a valve may be positioned along a connection line, where the valve may be activated to open to allow compressed gas to be released from the pressurized container and expand into the floatation chambers. The type of activation mechanism used to release compressed gas from a pressurized container to fill a floatation chamber may be selected, for example, based on the well environment.

Whichever activation mechanism is selected, according to embodiments of the present disclosure, the activation mechanism may be activated automatically after predetermined time. For example, the time for the inflatable multifunctional downhole tool to reach a target depth in the well may be calculated based on the tool weight and distance to the target depth. Once the calculated time has lapsed, compressed gas may be automatically released into the floatation chamber to inflate the floatation chamber and create buoyancy and upward force for the tool.

In some embodiments, an activation mechanism to release compressed gas from a pressurized container into a floatation chamber may be wirelessly activated. For example, one or more valves used in the release of compressed gas from a pressurized container may be wirelessly opened or closed. Wireless activation of the compressed gas release may be based, for example, on data collected and analyzed at the surface of the well (e.g., data from a navigation system indicating a location of the tool downhole and/or data from the tool sub indicating when a job has been completed).

A tool sub may be attached to the threaded connection of the tool body, where the tool sub may be selected to perform a selected job. In some embodiments, after a tool sub has been sent downhole on the inflatable multifunctional downhole tool and returned to the surface, the tool sub may be disconnected from the body and a new tool sub may be attached to the threaded connection of the body. For example, a new tool sub may be connected to the body to perform a different downhole job.

Figure 7:
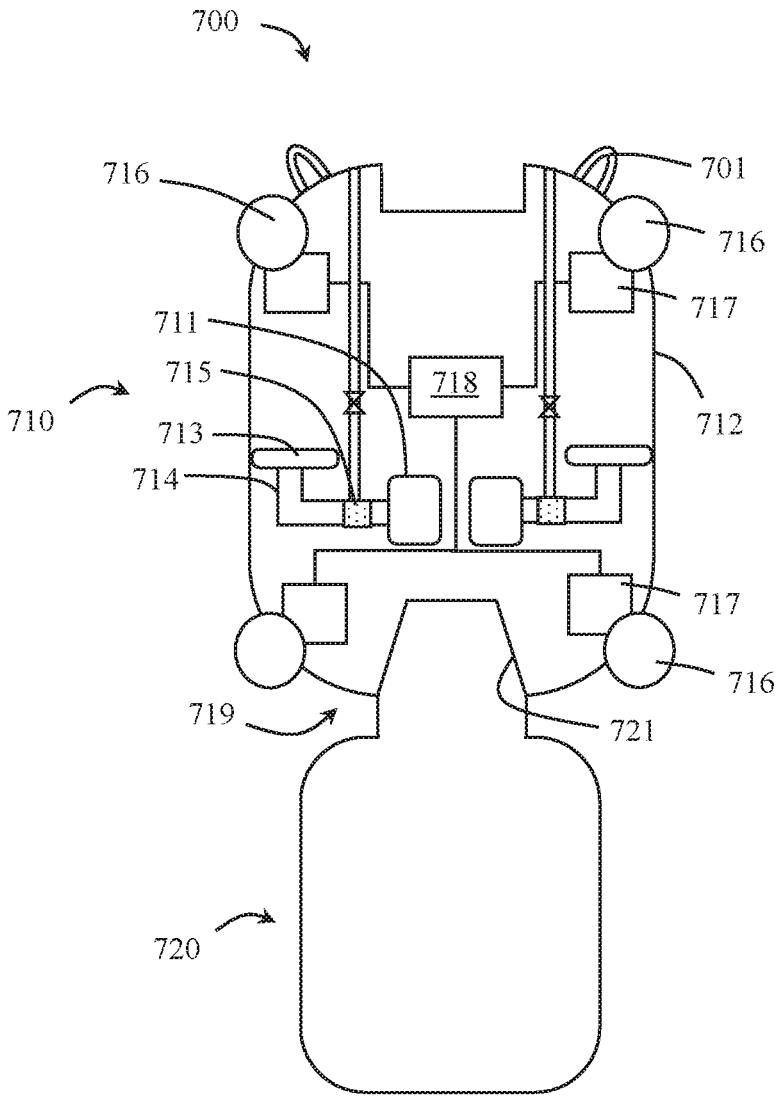
FIGS. 7-12 show different stages of using an inflatable multifunctional downhole tool according to embodiments of the present disclosure.

Referring now to FIGS. 7-12, a method for using inflatable multifunctional downhole tools according to embodiments of the present disclosure is shown. As shown in FIG. 7, an inflatable downhole tool 710 may have at least one pressurized container 711 disposed inside an outer shell 712 of the inflatable downhole tool 710. The pressurized container(s) 711 may be filled with an amount of compressed gas selected, for example, on the size and weight of the inflatable downhole tool 710. A plurality of floatation chambers 713 may be fluidly connected through connection lines 714 to the pressurized container(s). A dissolvable plug 715 may be positioned along each of the connection lines 714 between the floatation chambers 713 and the pressurized container(s). The inflatable downhole tool 710 may also include, for example, a navigation system, wheels 716, a motor system 717 to turn the wheels 716, one or more power sources 718 (e.g., to provide power to the motor system 717 and/or a navigation system), and/or hooks 701 provided around the outside of the tool body.

Depending on the downhole job to be performed, a tool sub 720 may be selected and connected to an axial end 719 of the inflatable downhole tool 710. The tool sub 720 may be connected to the inflatable downhole tool 710 by a threaded connection 721 to form an inflatable multifunctional downhole tool 700.

Figure 8:
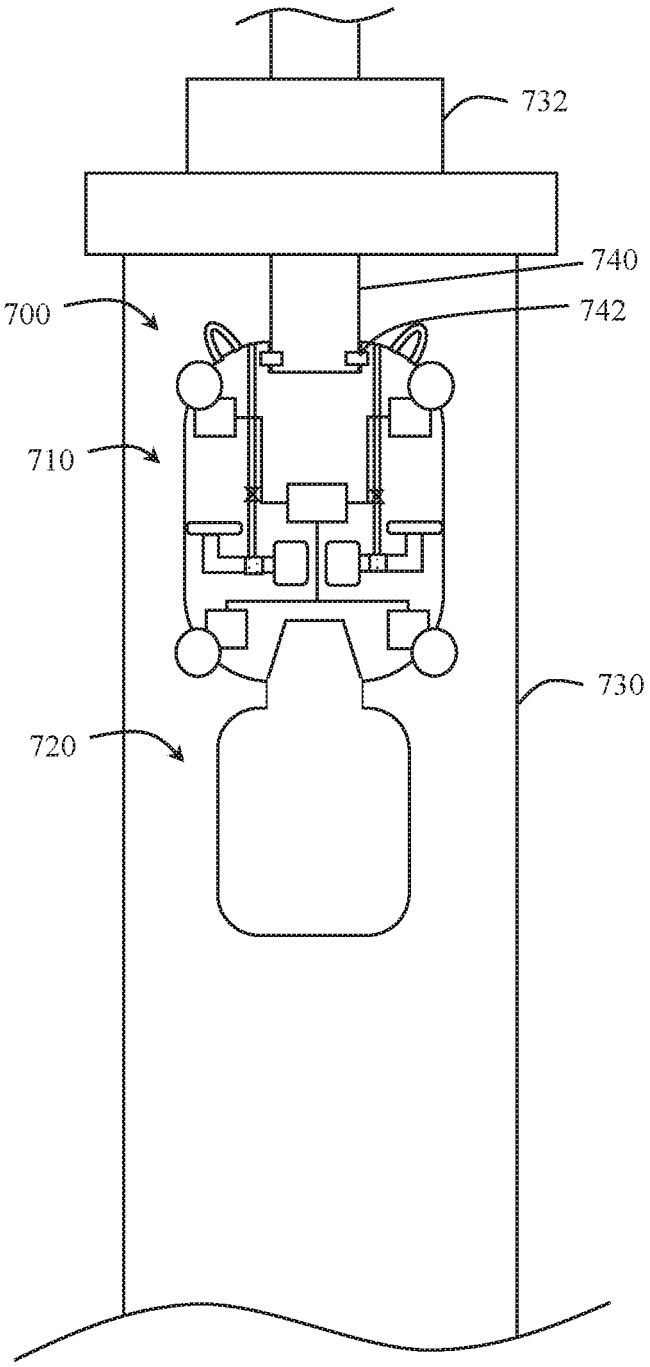
Figure 9:
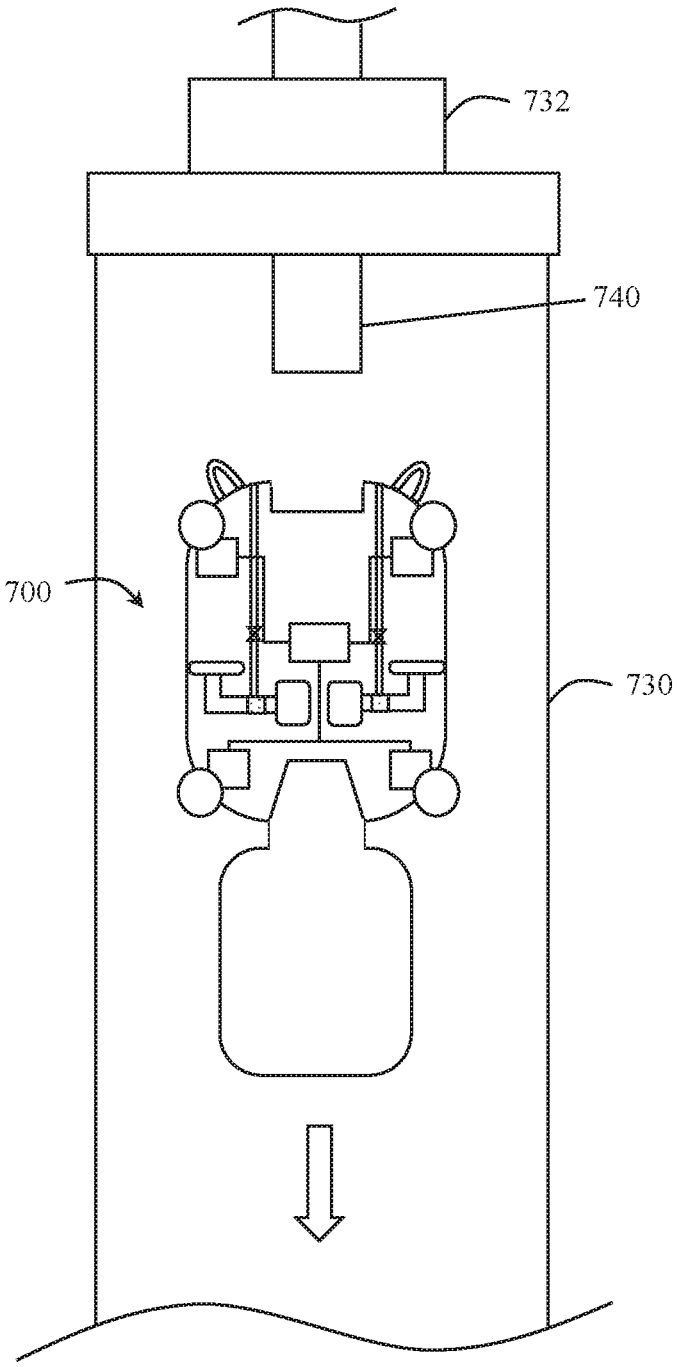

After attaching a tool sub 720 to the inflatable downhole tool 710, the inflatable multifunctional downhole tool 700 may be dropped down a well 730. For example, as shown in FIG. 8, an inflatable multifunctional downhole tool 700 may be sent down a well 730 using a running tool 740. The running tool 740 may be a tubular string (e.g., coiled tubing), slickline, or the like and may be attached to the inflatable downhole tool 710 at an axial end opposite the tool sub 720. For example, the running tool 740 may be attached to the inflatable downhole tool 710 using collapsible pins 742, J-slots, or other releasable locking mechanisms. The running tool 740 may lower the attached inflatable multifunctional downhole tool 700 into the well 730 (e.g., through a wellhead 732). When the inflatable multifunctional downhole tool 700 is in the well 730, the inflatable multifunctional downhole tool 700 may be released from the running tool 740 to drop the inflatable multifunctional downhole tool 700 from a distance above a target depth in the well 730. In other words, when the inflatable multifunctional downhole tool 700 is released from the running tool 740, the inflatable multifunctional downhole tool 700 may fall a distance through the well 730 by gravity, as shown in FIG. 9.

Figure 10:
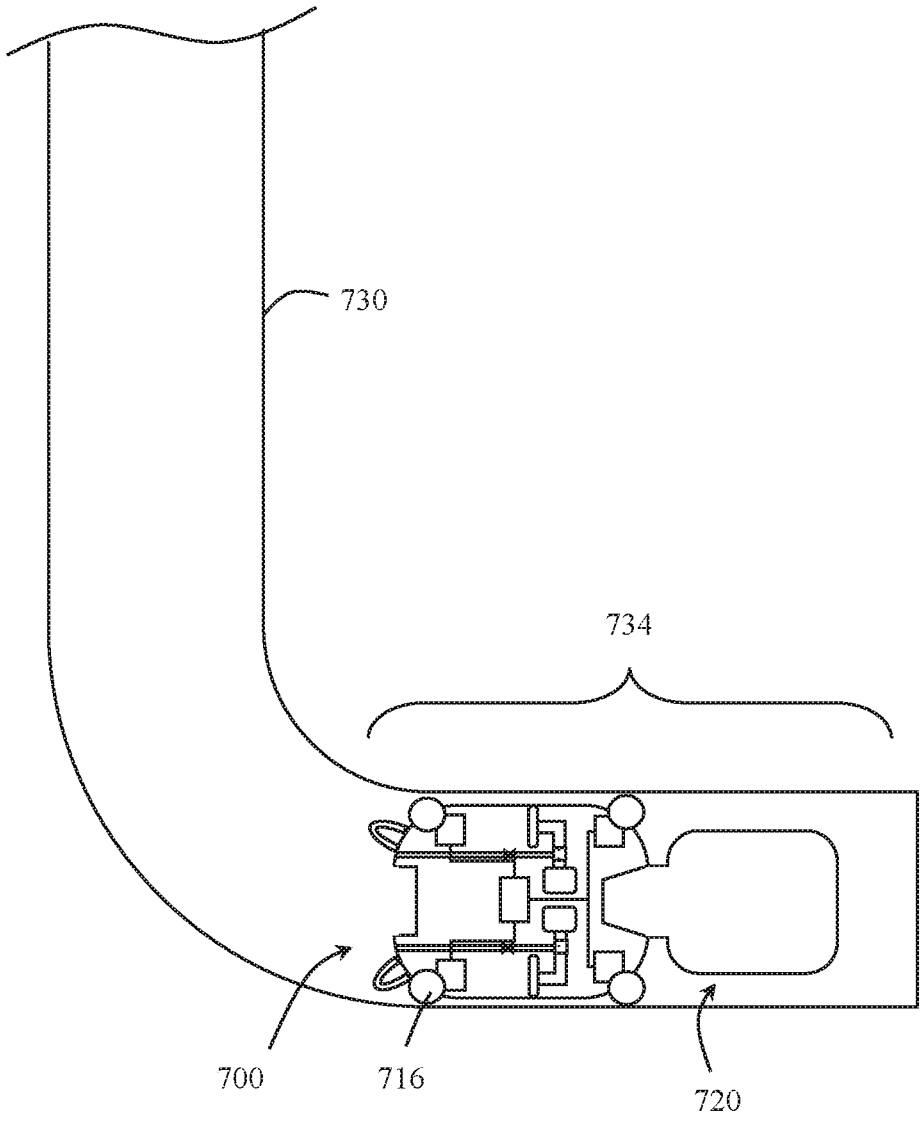

In some embodiments, after dropping the inflatable multifunctional downhole tool 700, the inflatable multifunctional downhole tool 700 may land on a deviated section of the well 730, a misalignment, or other type of non-uniform portion of the well 730. For example, as shown in FIG. 10, after dropping a distance through a vertical section of the well 730, the inflatable multifunctional downhole tool 700 may run into a horizontal section 734 of the well 730. In such case, a plurality of wheels 716 on the inflatable multifunctional downhole tool 700 may be rotated to run the inflatable multifunctional downhole tool 700 along the horizontal section 734 of the well 700. Wheels 716 on an inflatable multifunctional downhole tool 700 may be used to run the tool through other types of non-uniform portions of the well 730.

When the inflatable multifunctional downhole tool 700 reaches a target depth in the well 730, the tool sub 720 may perform a downhole job (e.g., taking at least one measurement, fishing something out of the well, etc.). For example, the tool sub 720 may be activated to perform a job using a wireless communication system, a timer, pressure activation, temperature activation, and/or one or more sensor triggers. After the tool sub 720 completes a job, at least one activation mechanism may be triggered to start floatation of the downhole tool 700. In some embodiments, after the tool sub 720 completes a job, wheels 716 may be used to transport the inflatable multifunctional downhole tool 700 to a vertical section of the well 730 prior to starting floatation of the downhole tool 700.

According to embodiments of the present disclosure, floatation of the inflatable downhole tool 710 may be triggered by triggering at least one activation mechanism to dissolve at least one dissolvable plug 715 in the inflatable downhole tool 710. When the at least one dissolvable plug 715 dissolves, at least one of the floatation chambers 713 in the inflatable downhole tool 710 may be filled with the compressed gas from the pressurized container(s) 711 to float the inflatable downhole tool 710 to an uphole position in the well 730. Activation mechanisms used to dissolve a dissolvable plug 715 may include, for example, a timer, designing a material and/or size of the dissolvable plug to dissolve at a selected dissolving rate, one or more check valves, wireless signals to open a valve, and/or others.

The amount of floatation chambers 713 to be inflated may be selected, for example, based on the weight of the multifunctional downhole tool 700 and/or the density of the well fluid (e.g., drilling fluid) in the well 730 surrounding the tool 700, and may be less than or all of the floatation chambers 713 in the inflatable downhole tool 710. An amount of dissolvable plugs 715 to be dissolved may be selected to correspond with the amount of floatation chambers 713 to be inflated. For example, an amount of floatation chambers to be inflated may be selected, and at least one activation mechanism may be triggered to dissolve a corresponding amount of dissolvable plugs 715. In some embodiments, all dissolvable plugs 715 in the inflatable downhole tool 710 may be dissolved upon a triggering event, and subsequently, all corresponding floatation chambers 713 may be inflated by fluidly connected pressurized containers 711.

As an example, triggering an activation mechanism may include using a downhole pressure to open a valve between a fluid source (e.g., from a fluid source compartment within the downhole tool 710 or well fluid from the exterior of the downhole tool 710) and a dissolvable plug 715 held in a connection line 714. When the fluid reaches the dissolvable plug 715, the fluid may dissolve the dissolvable plug 715 and open the connection line 714 to inflate a connected floatation chamber 713.

Figure 11:
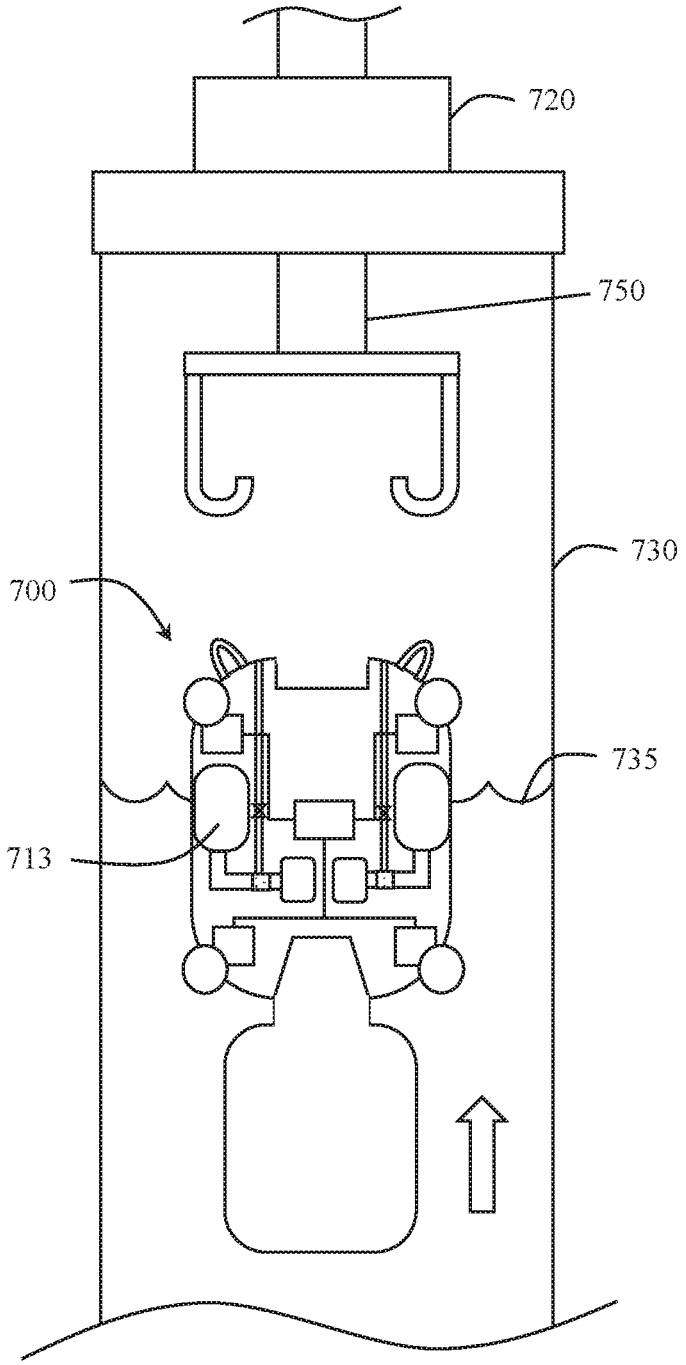

As shown in FIG. 11, when the floatation chambers 713 are inflated, the multifunctional downhole tool 700 may float in the well fluid 735 in the well 730 and rise toward the surface of the well 730. When the multifunctional downhole tool 700 reaches an uphole position in the well 730 (e.g., in an upper section of the well 730 proximate the wellhead 732), a retrieving tool 750 may be lowered into the well 730 to engage with the multifunctional downhole tool 700 and pull the multifunctional downhole tool 700 out of the well 730. The retrieving tool 750 may be the same tool as the running tool 740 or may be a different tool having a different engagement mechanism with the multifunctional downhole tool 700.

Figure 12:
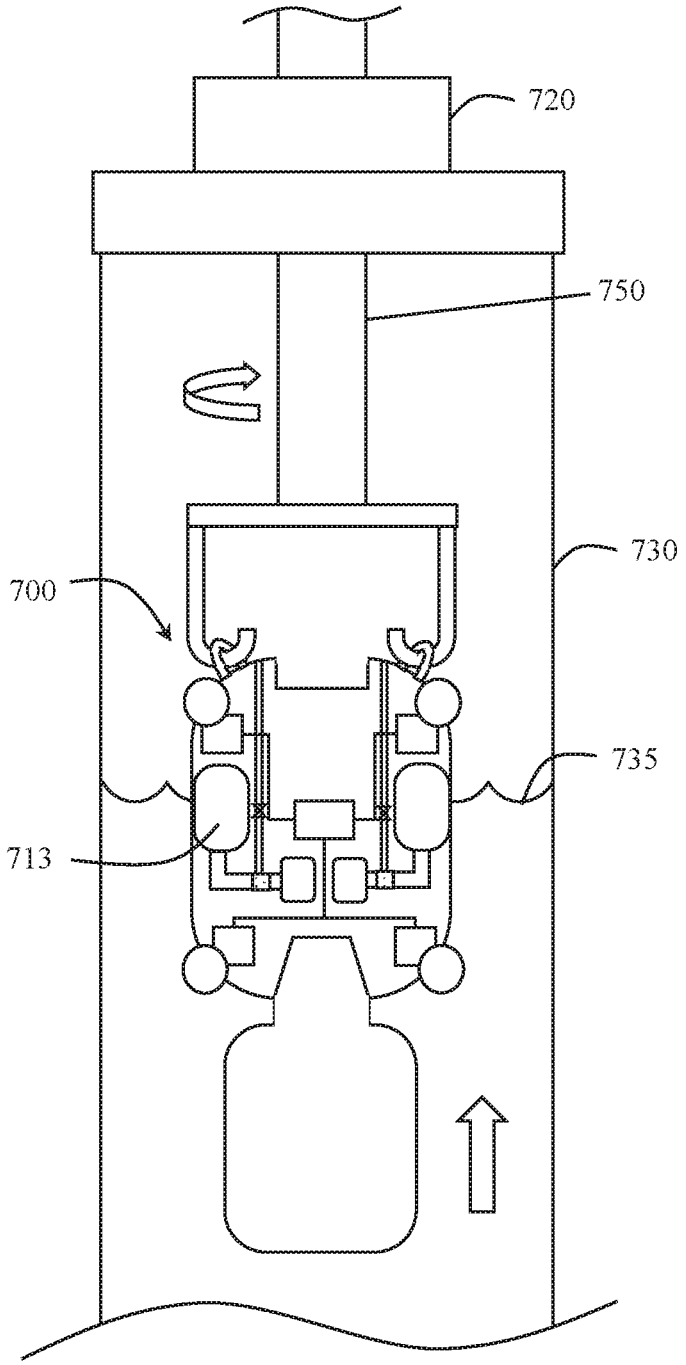

For example, as shown in FIGS. 11 and 12, a retrieving tool 750 may have one or more hooks 752 at an axial end of the retrieving tool 750, which may be used to engage with and hook into one or more hooks 701 on the multifunctional downhole tool 700. For example, the retrieving tool 750 may be run into the well 730 until the hooks 752 contact the multifunctional downhole tool 700, and then the retrieving tool 750 may be rotated until the hooks 752 hook into the downhole tool hooks 701. In some embodiments, the hooks 752, 701 may be magnetized to help with connection. Other types of connections may be made between a retrieving tool 750 and a multifunctional downhole tool 700, including, for example, interlocking features, threaded connections, and/or magnetized connection pieces.

When the multifunctional downhole tool 700 is retrieved from the well 730, the tool sub 720 may be disconnected from the inflatable downhole tool 710. A different tool sub or the same tool sub 720 may be reattached to the inflatable downhole tool 710 for a subsequent downhole job, and the process may be repeated.

Examples of applications in which an inflatable multifunctional downhole tool according to embodiments of the present disclosure may be used are provided below. However, inflatable multifunctional downhole tools according to embodiments of the present disclosure may be used in many other applications by altering the attached tool sub to perform a selected job.

EXAMPLE 1

A vertical well may be drilled to 12,000 feet and the temperature gradient is unknown. The temperature needs to be determined to precisely design cement slurry for lining the well. An oil and gas rated thermostat may be provided as a tool sub that is connected to an inflatable downhole tool according to embodiments of the present disclosure. The assembled inflatable multifunctional downhole tool may be dropped downhole into the well until the tool reaches the bottom of the well. The thermostat tool sub may record the temperature in the well as it travels down to the bottom of the well. The maximum recorded temperature at the bottom of the well is the bottom hole static temperature (BHST). After the inflatable multifunctional downhole tool reaches the bottom of the well, floatation chambers inside the inflatable downhole tool may be inflated, such that the multifunctional downhole tool floats back up toward the surface of the well. The inflated multifunctional downhole tool may then be pulled out of the well, where the temperature recordings, including the BHST, may be obtained.

EXAMPLE 2

A tool is dropped down a well. For example, while changing logging tools at the surface of a well, the hole cover to the well was removed to allow running logging tools into the well, and a logging hand accidentally dropped a tool (e.g., an allen key) into the hole. An inflatable downhole tool according to embodiments of the present disclosure may be connected to a junk basket or a magnet tool sub and dropped into the wellbore to capture the dropped tool and float back to the surface. While such a retrieval operation would typically require an average of 24 hours in a 9,000-foot well, the same retrieval operation may take less than 20 percent of the time using methods and apparatuses of the present disclosure.

EXAMPLE 3

While drilling 12-¼" diameter hole size, there was a concern that the well is deviating and entering a different formation. The expected formation is sandstone, and anhydrite cuttings are reported at surface. The decision is made to pull out of the hole and measure wellbore deviation. An inflatable downhole tool according to embodiments of the present disclosure may be connected to a deviation survey tool sub and dropped downhole. After deviation measurements are taken, floatation chambers in the inflatable downhole tool may be inflated, and the inflated downhole tool may be floated back toward the surface of the well to be retrieved. Once retrieved, the well inclination measurements may be obtained and analyzed to determine if the well has deviated.

EXAMPLE 4

A well is drilled to a desire depth and partial loss of circulation is encountered. Lost circulation occurs when drilling fluid flows into formations instead of returning up the annulus of the well to the surface. An inflatable downhole tool may be connected to a hydrostatic gauge tool sub and dropped downhole. The inflatable multifunctional downhole tool may then be floated back toward the surface of the well, where once retrieved at the surface, the drilling fluid column height may be calculated from the retrieved downhole measurements, and a lost circulation zone may be determined. Identifying the lost circulation zone may allow for effective lost circulation treatment. For example, a lost circulation zone may be encountered in a 7,000-foot vertical wellbore, where 72 pound cubic feet (pcf) drilling fluid density is pumped into the well. The hydrostatic pressure at bottom of the well is supposed to be 3,500 psi ((72 pcf/144) *7,000 feet). However, due to the lost circulation zone, some of the drilling fluid flows into the formation, and the drilling fluid column is reduced. The inflatable multifunctional downhole tool may be used to obtain the hydrostatic pressure from downhole. For example, the inflatable multifunctional downhole tool may measure a hydrostatic pressure of 3,000 psi after the losses. Thus, the calculated hydrostatic pressure is decreased by 500 psi (3,500 psi-3,000 psi). By back calculating the drilling fluid column, a lost circulation zone location may be determined to be at 6,000 feet ((3,000 psi*144)/72 pcf) above the bottom of the well (1,000 feet below the surface).

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A downhole tool, comprising:

a body comprising an outer shell and a threaded connection at an axial end of the body;

at least one pressurized container disposed inside the outer shell, the pressurized container containing compressed gas;

a plurality of floatation chambers fluidly connected through connection lines to the at least one pressurized container, wherein the floatation chambers are held inside the outer shell before being inflated and after being inflated;

a dissolvable plug positioned along each of the connection lines between the floatation chambers and the at least one pressurized container; and a tool sub threadably connected to the threaded connection of the body.

2. The downhole tool of claim 1, further comprising a plurality of wheels positioned around the outer shell.

3. The downhole tool of claim 2, further comprising at least one battery and a motor positioned inside the body and operatively connected to the plurality of wheels.

4. The downhole tool of claim 1, wherein the tool sub comprises a fishing tool.

5. The downhole tool of claim 1, wherein the tool sub comprises a logging tool.

6. The downhole tool of claim 1, further comprising at least one hook positioned at an opposite axial end of the body from the threaded connection.

7. The downhole tool of claim 1, further comprising a wireless communication system.

8. The downhole tool of claim 1, further comprising at least one fluid source compartment holding a fluid and a valve positioned between the fluid in the fluid source compartment and the dissolvable plug, wherein the fluid is in fluid communication with the dissolvable plug when the valve is open.

9. A method, comprising:

providing an inflatable downhole tool comprising:

at least one pressurized container disposed inside an outer shell of the inflatable downhole tool, the pressurized container containing compressed gas;

a plurality of floatation chambers fluidly connected through connection lines to the at least one pressurized container; and a dissolvable plug positioned along each of the connection lines between the floatation chambers and the at least one pressurized container;

connecting a tool sub to an axial end of the inflatable downhole tool;

sending the inflatable downhole tool down a well;

triggering at least one activation mechanism to dissolve at least one of the dissolvable plugs; and when the at least one dissolvable plug dissolves, inflating at least one of the floatation chambers with the compressed gas to float the inflatable downhole tool to an uphole position in the well.

10. The method of claim 9, wherein triggering comprises:

selecting an amount of the plurality of floatation chambers to be inflated based on a weight of the tool sub; and triggering an amount of the at least one activation mechanism to dissolve the at least one dissolvable plug corresponding to the amount of the plurality of floatation chambers to be inflated.

11. The method of claim 9, wherein sending the inflatable downhole tool down the well comprises:

lowering the inflatable downhole tool into the well with a running tool; and releasing the inflatable downhole tool from the running tool to drop the inflatable downhole tool from a distance above a target depth in the well.

12. The method of claim 11, further comprising, after dropping the inflatable downhole tool, rotating a plurality of wheels on the inflatable downhole tool to run the inflatable downhole tool along a portion of the well.

13. The method of claim 9, wherein triggering the at least one activation mechanism comprises:

using a downhole pressure to open a valve between a dissolving compartment and the connection line to release a fluid held in the dissolving compartment;

wherein when the fluid reaches the dissolvable plug in the connection line, the fluid dissolves the dissolvable plug.

14. The method of claim 9, wherein triggering the at least one activation mechanism comprises allowing drilling fluid to enter the connection line and contact the dissolvable plug for a period of time.

15. The method of claim 9, further comprising:

lowering a retrieving tool into the well to engage the inflatable downhole tool at the uphole position in the well; and pulling the inflatable downhole tool out of the well with the retrieving tool.

16. The method of claim 9, further comprising removing the tool sub and connecting a different tool sub to the axial end of the inflatable downhole tool.

17. A method of assembling a downhole tool, comprising:

providing a body of an inflatable downhole tool comprising an outer shell and a threaded connection at an axial end of the body, wherein the outer shell is designed to contain floatation chambers when the floatation chambers are inflated;

providing the floatation chambers inside the outer shell when the floatation chambers are uninflated;

providing at least one pressurized container inside the body, wherein connection lines fluidly connect the at least one pressurized container to the floatation chambers;

positioning a dissolvable plug in at least one connection line to plug an opening to the pressurized container; and attaching a tool sub to the threaded connection.

18. The method of claim 17, further comprising filling the at least one pressurized container with a compressed gas.

19. The method of claim 18, wherein an amount of the compressed gas is selected based on a weight of the tool sub.

20. The method of claim 17, further comprising replacing the tool sub with a new tool sub.

* * * * *